United States Patent [19]

Hodil

[11] 3,949,922

[45] Apr. 13, 1976

[54] POWDER-ACTUATED TOOL

[75] Inventor: Elmer R. Hodil, Branford, Conn.

[73] Assignee: Olin Corporation, New Haven, Conn.

[22] Filed: Apr. 28, 1975

[21] Appl. No.: 572,048

Related U.S. Application Data

[63] Continuation-in-part of Ser. No. 494,663, Aug. 5, 1974.

[52] U.S. Cl. ..... 227/10

[51] Int. Cl.[2] ..... B25C 1/14

[58] Field of Search ..... 227/8, 10, 11

[56] References Cited

UNITED STATES PATENTS

| | | | |
|---|---|---|---|
| 3,066,303 | 12/1962 | Kopf et al. | 227/10 |
| 3,095,572 | 7/1963 | Massacrier | 227/11 |
| 3,172,123 | 3/1965 | Helderman et al. | 227/11 |
| 3,622,060 | 11/1971 | Gussalli | 227/8 |
| 3,643,850 | 2/1972 | Endo | 227/10 |

*Primary Examiner*—Granville Y. Custer, Jr.
*Attorney, Agent, or Firm*—Donald R. Motsko; H. S. Kieser; William W. Jones

[57] ABSTRACT

A powder-actuated tool includes a housing and a barrel assembly moveable therein and extending therefrom. A fastener driving member is moveable in the bore of a barrel assembly between a driving position and a driven position. A muffler member surrounds said barrel assembly external of said housing and forms a chamber between said muffler member and said barrel assembly. Suitable ports are provided in the barrel assembly to vent gases from the bore to the chamber.

8 Claims, 3 Drawing Figures

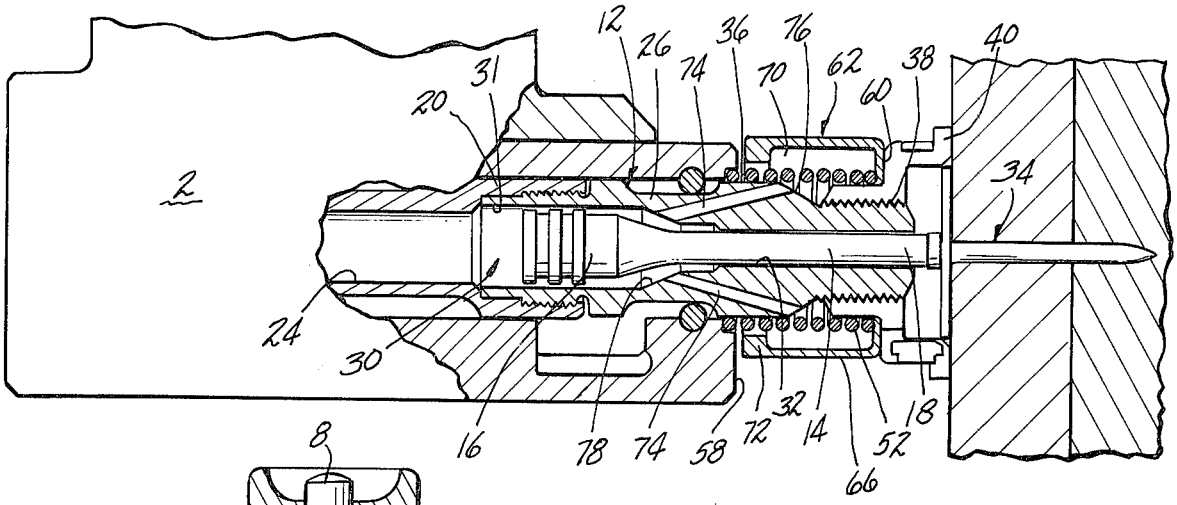
FIG-3
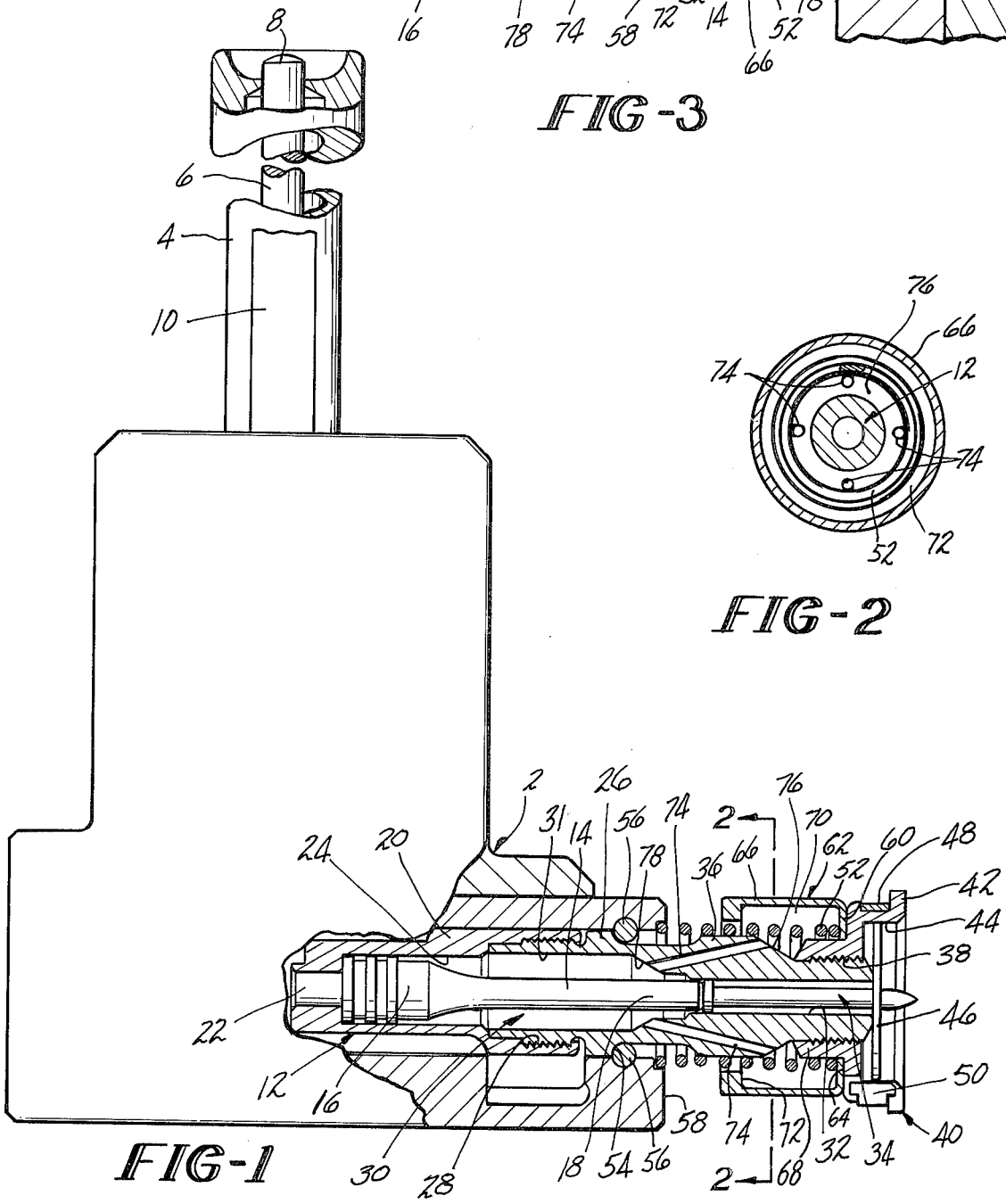
FIG-1
FIG-2

POWDER-ACTUATED TOOL

RELATED CASE

This application is a continuation-in-part of co-pending application Ser. No. 494,663, filed Aug. 5, 1974 entitled Powder-Actuated Tool.

BACKGROUND OF INVENTION

This invention relates to powder actuated tools, and more particularly to a powder actuated tool having an improved muffler arrangement to reduce the noise level of the tool. The operation of the powder actuated tools is accompanied by a certain level of noise due to the ingnition of the propellant charge and the expansion of gases generated thereby. In certain applications, some noise may be objectionable due to excess surrounding noise. One such application is the use of a powder-actuated tool in steel mills to fasten heat insulating boards to the inside of the upper end of an ingot mold to provide heat insulating liners or "hot top". Because of the noise level normally present in the steel mill, the additional noise due to the operation of a powder actuated tool may be considered objectionable.

SUMMARY OF INVENTION

One object of the present invention is to provide an improved muffler arrangement for a powder actuated tool to reduce the noise level thereof.

An additional object of the present invention is the provision of a tool which can be used for fastening insulating boards to ingot molds and which has a muffler arrangement to reduce the noise level of the tool during the operation thereof.

These and other objects of the present invention may be realised according to the preferred embodiment of the present invention through the provision of a tool which includes a barrel assembly mounted in a housing for movement between a forward position and a rearward driving position. A fastener driving member is mounted in a bore in the barrel assembly. A muffler member surrounds said barrel assembly external of said housing forming a chamber between the exterior of said barrel assembly and said muffler member. Means are provided to bleed the gases generated by the powder charge from the bore to the chamber.

A spring member in the form of a coil spring may be provided to bias the barrel assembly into its forward position. The spring member has a portion which is located in the chamber and is compressed when said barrel assembly is moved from its forward position to its rearward position.

The chamber may be provided with an opening to the atmosphere. The position of the opening is such that the gases effectively reverse direction when finally bled to the atmosphere.

DESCRIPTION OF THE DRAWINGS

The objects and advantages of the present invention will become more apparent by reference to the following description of a preferred embodiment and to the accompanying drawings in which:

FIG. 1 is a partial side view of a tool, partially in section, showing the improved muffler arrangement according to the preferred embodiment of the invention;

FIG. 2 is a transverse sectional view taken along the lines 2—2 of FIG. 1; and

FIG. 3 is a partial side view of the tool of FIG. 1 showing the tool in its position immediately after a fastening operation with the barrel assembly in the rearward driving position.

DETAILED DESCRIPTION

The tool shown in the drawings is generally the same as the tool shown and described in the above mentioned co-pending application Ser. No. 494,663 and the description and drawings of such co-pending application are hereby incorporated by reference into this application.

Although reference should be made to co-pending application Ser. No. 494,663 for a complete understanding of the working mechanism of the tool, the tool as shown herein generally includes a housing 2 having an elongated handle 4 attached thereto with a trigger rod 6 extending through the handle and terminating in a trigger button 8 accessible from the free end of the handle 4. An operating handle (not shown) is slidably mounted on the handle 4 and includes an extension arm 10 extending into the housing 2 to actuate the various mechanisms of the tool in a manner fully explained in said co-pending application.

A barrel assembly 12 is mounted in the housing 2 for movement between a forward position as shown in FIG. 1 and a rearward driving position as shown in FIG. 3. Mounted within the barrel assembly is a piston member 14 having an enlarged head portion 16 and a reduced ram portion 18. The piston member 14 is moveable from its rearward position shown in FIG. 1 to its forward position shown in FIG. 3 under the influence of the gases generated by the ignition of a suitable propellant charge.

The barrel assembly 12 includes a barrel member 20 which may have a propellant charge receiving chamber 22 at its rearward end. The propellant charge may be contained in a cartridge case, or may be a consolidated caseless charge as in the form of a pellet. Barrel member 20 is provided with a bore 24 of a size to slidably receive the head portion 16 of the piston 14. A barrel extension 26 has its rearward end threadedly secured in a suitable counter bore 28 in member 20. The barrel extension 26 includes a bore 30 having rearward portion 31 of a diameter slightly greater than the diameter of the head portion 16 of the piston member 14. The bore 30 tapers inwardly and forwardly to reduced bore 32 having a diameter of appropriate size to receive ram portion 18 of the piston member 14 and also a suitable fastener 34. The outer surface of the barrel extension 26 includes an enlarged portion 36 which tapers forwardly and inwardly to a reduced threaded portion 38.

A washer guide member 40 is threadedly attached to the threaded portion 38 of the barrel extension 26 and includes an enlarged flange portion 42 having a bore 44 therein of a sufficient size to contain the enlarged washer 46 of the fastener member 34 to be set. A band spring member 48 surrounds the outer surface of the flange portion 42 and has one end 50 turned inwardly into the bore 44 to frictionally engage the washer member 46 to retain the fastener member 34 in the tool.

The barrel assembly 12 is biased into its forward position by a suitable coil spring member 52. In the forward position of the barrel assembly 12, a shoulder 54 on the barrel extension 26 engages horizontally extending stop members 56 provided in the housing 2. The spring 52 extends between the forward face 58 of the housing 2 and the inside surface of an inturned flange 60 on a muffler member 62. The spring 52 forces the flange 60 into engagement with the rearward surface 64 of the washer guide member 40 as well as urges the barrel assembly 12 into its forward position.

The muffler member 62 includes a generally hollow, cylindrical body portion 66 with the forward inturned flange 60 thereof circumferentially engaging the rearward extension 68 of the washer guide member 40. The interior diameter of the body portion 66 of the muffler member 62 is of sufficient size so that it is spaced from the barrel assembly 12 to provide a gas expansion chamber 70. The rearward end of the muffler member 60 is provided with an inturned flange 72 which terminates at a point spaced from an enlarged portion 36 of the barrel extension 26 a sufficient distance to provide clearance for the spring member 52 as well as clearance to vent the gases to the atmosphere. The length of the muffler member 62 is such that it is slightly spaced in an axial direction from the forward face of the housing 2 when the barrel assembly 12 is in its rearward driving position as shown in FIG. 3.

Suitable ports 74 are provided in the barrel extension 26 as shown in FIGS. 1 and 2. In the preferred embodiment, there are four such ports 74 extending from the tapered surface 76 on the exterior of the barrel extension 26 to a tapered surface 78 in the interior of the barrel extension 26. The ports 74 in the barrel extension 26 open into the expansion chamber 70 formed by the muffler member 62.

In order for the tool to be fired, the operating handle must be actuated to cock the firing mechanism and ensure that a propellant charge is in alignment with the chamber 22 on the barrel assembly 12 as fully explained in the co-pending application Ser. No. 494,663. In order to fire the tool, the forward face of the washer guide member 40 must be positioned against a suitable work surface and the tool moved forwardly so that the barrel assembly 12 is moved into its rearward position.

After the trigger button 8 is actuated, and the propellant charge is ignited, the gases act on the rearward face of the head portion 16 of the piston 14 and drive the piston 14 forwardly and the piston 14 in turn, drives the fastener member 34 into the work surface. As soon as the head portion 16 of the piston 14 emerges from bore 24, the gases generated by the ignition of the propellant charge can pass around the head portion 16 and escape into the expansion chamber 70 through the ports 74 and eventually out to the atmosphere through the space between the inturned flange 72 and the barrel assembly 12. It is to be noted that the spring member 52 is compressed when the barrel assembly 12 is in its rearward firing position so that the coils are relatviely close to each other. As the gases must pass through spaces between the coils of the spring before it can pass through the space between the rearward flange 72 and the exterior of the barrel assembly 12 into the atmosphere, the spring member serves to add turbulence to the gas, helping to reduce the noise level of the tool. In addition, by positioning the opening from the chamber 70 to the atmosphere at the rear of the muffler member 62, the gases which at first are moving forward in the tool are reversed and exit from the chamber in a rearward direction, helping to further reduce the noise level.

What is claimed is:

1. In a powder actuated tool, a housing, a barrel assembly mounted in said housing and having a portion extending forwardly therefrom and being moveable between a rearward firing position and a forward position, a bore in said barrel assembly, a fastener driving member mounted in said bore for movement between a rearward driving position and a forward driven position, a muffler member surrounding said barrel assembly forwardly of and separate from said housing and forming a chamber between the exterior surface of said barrel assembly and said muffler member, and means for bleeding gases generated by the powder charge upon actuation of the tool from said bore to said chamber.

2. In the powder-actuated tool of claim 1, a coil spring member biasing said barrel assembly into its forward position and having at least a portion thereof in said chamber, said spring member being compressed when said barrel assembly is moved from its forward position to its rearward position.

3. In the powder-actuated tool of claim 2, an opening from said chamber to said atmosphere.

4. In a powder-actuated tool of claim 1, said fastener driving member including an enlarged head portion and a reduced ram portion, said bore including a rearward portion of a size to receive said head portion, an intermediate portion having a larger cross-section than said rearward portion, and a forward reduced portion to receive said ram portion, said head portion being proportioned in said intermediate portion when said fastener driving member is in its forward position, whereby said gases can bleed forwardly of said head portion, and at least one port in said barrel assembly providing communication between said bore at a point forwardly of said head portion when said fastener driving member is in its forward position and said chamber.

5. In the powder-actuated tool of claim 4, a coil spring member biasing said barrel assembly into its forward position and having at least a portion thereof in said chamber, said spring member being compressed when said barrel assembly is moved from its forward to its rearward position.

6. In the powder-actuated tool of claim 5, said barrel assembly including shoulder means adjacent its forward end for providing a surface for the spring force to act in a forward direction upon said barrel assembly, said muffler member including a hollow cylindrical body portion spaced from the exterior of said barrel assembly, a forward inturned flange at its forward end, said shoulder means, a rearward inturned flange terminated in a surface spaced radially outwardly from said barrel assembly and said spring.

7. In the powder-actuated tool of claim 1, an elongated handle extending from said housing in a direction transversely of said barrel assembly and means adjacent the free end of said handle to actuate the tool.

8. In the powder-actuated tool of claim 7, said barrel assembly including at its forward end a washer retaining member for receiving a washer member attached to a fastener to be driven by said tool.

* * * * *